US010829268B2

(12) United States Patent
Sommer

(10) Patent No.: US 10,829,268 B2
(45) Date of Patent: Nov. 10, 2020

(54) BLIND-STACK AND NEST-INTERLOCK CONTAINER

(71) Applicant: Monoflo International, Inc., Winchester, VA (US)

(72) Inventor: Axel Sommer, Tacoma, WA (US)

(73) Assignee: MONOFLO INTERNATIONAL, INC., Winchester, VA (US)

( * ) Notice: Subject to any disclaimer, the term of this patent is extended or adjusted under 35 U.S.C. 154(b) by 0 days.

(21) Appl. No.: 15/925,997

(22) Filed: Mar. 20, 2018

(65) Prior Publication Data

US 2018/0273245 A1 Sep. 27, 2018

Related U.S. Application Data

(60) Provisional application No. 62/474,159, filed on Mar. 21, 2017.

(51) Int. Cl.
*B65D 21/032* (2006.01)
*B65D 21/02* (2006.01)

(52) U.S. Cl.
CPC ..... *B65D 21/0212* (2013.01); *B65D 21/0202* (2013.01); *B65D 21/0213* (2013.01); *B65D 21/0235* (2013.01)

(58) Field of Classification Search
CPC ..... B65D 21/0212; B65D 1/0202; B65D 21/0213; B65D 21/0235
USPC ..... 220/23.6; 206/509, 511, 503
See application file for complete search history.

(56) References Cited

U.S. PATENT DOCUMENTS 3,934,724 A 1/1976 Johnson
3,951,265 A 4/1976 Carroll
4,102,453 A 7/1978 Carroll et al.
4,189,052 A * 2/1980 Carroll ..... B65D 21/041 206/507
4,308,954 A * 1/1982 Wilson ..... B65D 21/048 206/505
4,320,837 A 3/1982 Carroll et al.
5,582,296 A * 12/1996 Beauchamp ..... B65D 1/42 206/503
5,595,338 A 1/1997 Abler
5,881,902 A * 3/1999 Ackermann ..... B65D 21/041 206/507
6,062,388 A * 5/2000 Ohayon ..... B65D 21/0216 206/507
6,273,259 B1 * 8/2001 Stahl ..... B65D 21/046 206/509

(Continued)

*Primary Examiner* — J. Gregory Pickett
*Assistant Examiner* — Niki M Eloshway
(74) *Attorney, Agent, or Firm* — Nixon & Vanderhye P.C.

(57) ABSTRACT

A crate is configured for blind-stacking on an adjacent crate with side walls. The crate may include a bottom panel, end walls extending from the bottom panel, and side walls extending from the bottom panel and connected between the end walls. The side walls include a stacking rim on a top surface. The bottom panel may include guide ribs under the side walls, respectively, and positioned adjacent a forward end of the crate. The guide ribs may be sized and shaped to positively engage the side walls of the adjacent crate, and the guide ribs may be configured to prevent the side walls of the adjacent crate from deflecting outward under load. The crate facilitates blind-stacking and helps to minimize the effort for an operator to handle heavier loads.

13 Claims, 11 Drawing Sheets

(56) References Cited

U.S. PATENT DOCUMENTS

| | | | | |
|---|---|---|---|---|
| 7,686,167 | B1 * | 3/2010 | Stahl | B65D 21/045 206/507 |
| 7,690,856 | B2 * | 4/2010 | Mortensen | A01K 61/54 403/326 |
| 9,926,164 | B2 | 3/2018 | Jeschke et al. | |
| 2003/0183549 | A1 * | 10/2003 | Verna | B65D 21/045 206/509 |
| 2004/0206655 | A1 * | 10/2004 | Bennett | G11B 33/0461 206/503 |
| 2005/0183980 | A1 * | 8/2005 | Fernandez | B65D 1/34 206/509 |
| 2008/0110790 | A1 * | 5/2008 | McTavish | B65D 21/0213 206/511 |
| 2009/0178989 | A1 * | 7/2009 | Accuardi | A47B 87/0269 211/126.7 |
| 2014/0261910 | A1 * | 9/2014 | Trybus | C22C 19/007 148/556 |

* cited by examiner

BLIND-STACK AND NEST-INTERLOCK CONTAINER

CROSS-REFERENCES TO RELATED APPLICATIONS

This application claims the benefit of U.S. Provisional Patent Application No. 62/474,159, filed Mar. 21, 2017, the entire content of which is herein incorporated by reference.

STATEMENT REGARDING FEDERALLY SPONSORED RESEARCH OR DEVELOPMENT (Not Applicable)

BACKGROUND

The invention relates to crates and, more particularly, crates that are configured to facilitate blind-stacking and to prevent crate walls from deflecting under load.

The term "blind-stacking" refers to sliding a top crate in a stack of crates along the side of an adjacent crate into a nested position. The top crate is self-guided on the walls of the lower crate. The bottom of the top crate is gliding on top of the adjacent wall until the crate finds its nested position. Blind-stacking is used to column stack crates. It is difficult to manually blind-stack crates with heavy loads.

Additionally, the term "nest interlock" refers to preventing the walls of the bottom crate from bending outwards under load. It is a common problem that the top of crate walls could be pushed outwards when stacked. When this happens, the bottom of the top crate loses contact to the wall below, which triggers a significant loss of stacking strength of the crate column and a high risk that the stack could collapse. This scenario creates a high risk of injuries and damaged product. That is, with existing crates, the side walls of the lower crate in a stack of crates tend to bend outwards under the load of the top crate, and the top crate could drop into the lower crate and damage the contents or packaging.

With existing designs, it is also time-consuming to correct any misalignment.

BRIEF SUMMARY

The crate according to the described embodiments facilitates blind-stacking and helps to minimize the effort (more ergonomically/less lifting time) for an operator to handle heavier crates. This becomes even more important when the crates are stacked above waist level. Moreover, the design of the described embodiments provides an outer guide rib at least at the front of the bottom of the base that prevents the walls from bending out under load. This feature provides the ability to blind-stack securely.

A guide rib for blind-stacking provides a positive locking of the base to the top of the sidewall of the crate below. This could be accomplished by a protrusion (rib) extending over the stacking rim, creating a positive lock with the side wall while sliding the crate into the nested position. The rib may be as close as possible to the front of the base to maximize engagement. It can be either at the perimeter of the stacking rim (simple for mold built) or in the middle to engage in a groove (which requires additional slide action in the mold).

In an exemplary embodiment, a crate configured for blind-stacking on an adjacent crate with side walls includes a bottom panel, end walls extending from the bottom panel, and side walls extending from the bottom panel and connected between the end walls. The side walls include a stacking rim on a top surface. The bottom panel may include guide ribs under the side walls, respectively, and positioned adjacent a forward end of the crate. The guide ribs may be sized and shaped to positively engage the side walls of the adjacent crate, and the guide ribs may be configured to prevent the side walls of the adjacent crate from deflecting outward under load.

At least portions of the guide ribs may be spaced apart by a distance greater than a distance between the side walls. The stacking rim may include a central groove, where the guide ribs may be positioned in alignment with the central groove. A geometry of the guide ribs and bottom panel may complement a shape of the stacking rim.

In some embodiments, the bottom panel may also include interlocking ribs under the side walls, respectively, and positioned between forward and aft ends of the crate. The interlocking ribs may be sized and shaped to positively engage the side walls of the adjacent crate. The geometry of the interlocking ribs and bottom panel may complement a shape of the stacking rim. The bottom panel may include interlocking ribs under the end walls, respectively, where the interlocking ribs may be sized and positioned to positively engage end walls of the adjacent crate.

In another exemplary embodiment, a method of blind-stacking a crate on an adjacent crate with side walls includes the steps of (a) aligning the guide ribs with the side walls of the adjacent crate; (b) positively engaging the guide ribs and the side walls of the adjacent crate, where the guide ribs are configured to prevent the side walls of the adjacent crate from deflecting outward under load; and (c) with the guide ribs positively engaging the side walls of the adjacent crate, sliding the crate over the adjacent crate to a stacked position.

BRIEF DESCRIPTION OF THE DRAWINGS

These and other aspects and advantages of the invention will be described in detail with reference to the accompanying drawings, in which.

DETAILED DESCRIPTION

Figure 1:
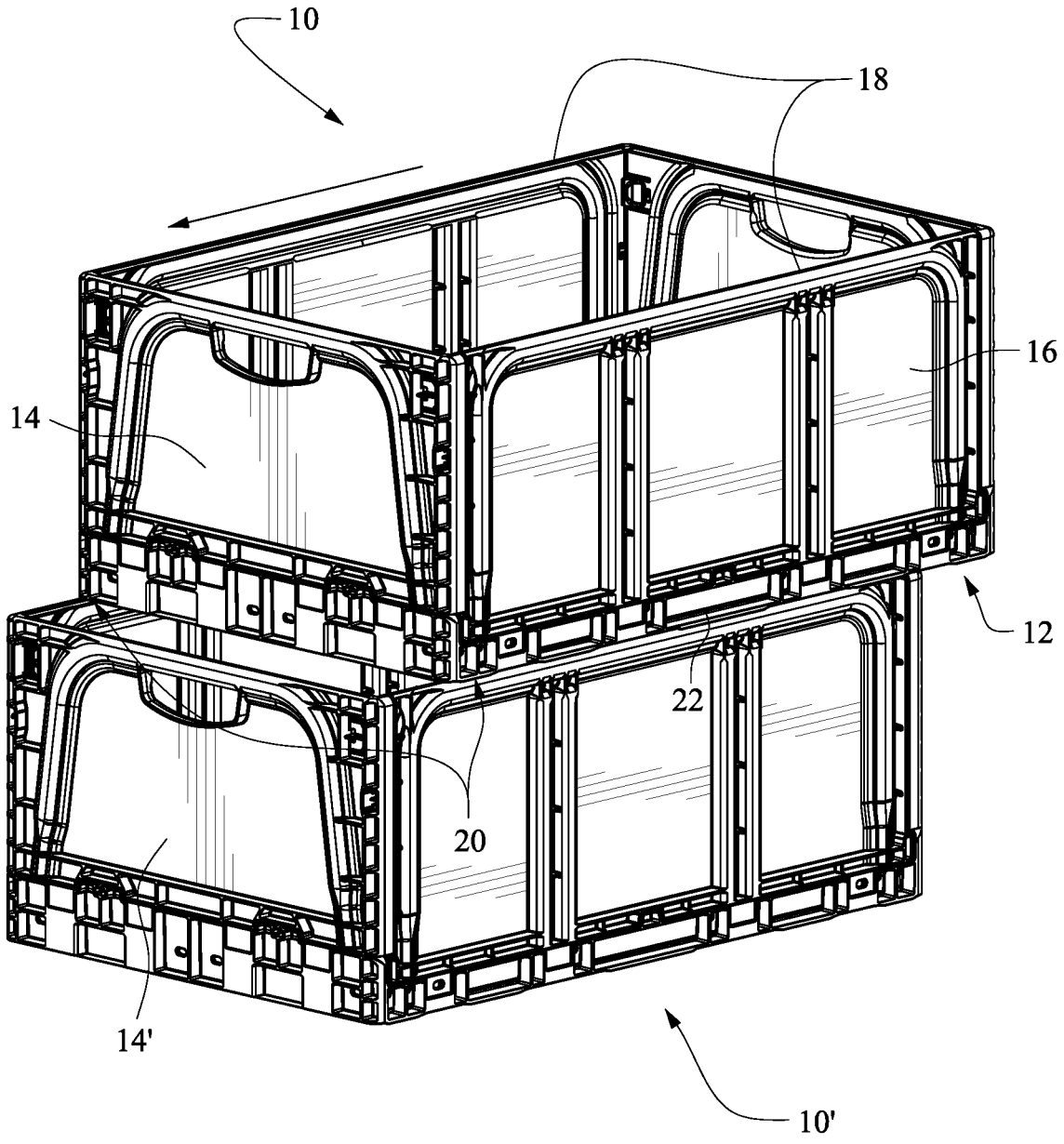
FIGS. 1 and 2 are perspective views showing a crate configured for blind-stacking on an adjacent crate in a travel position and a nest or stacked position, respectively.
Figure 2:
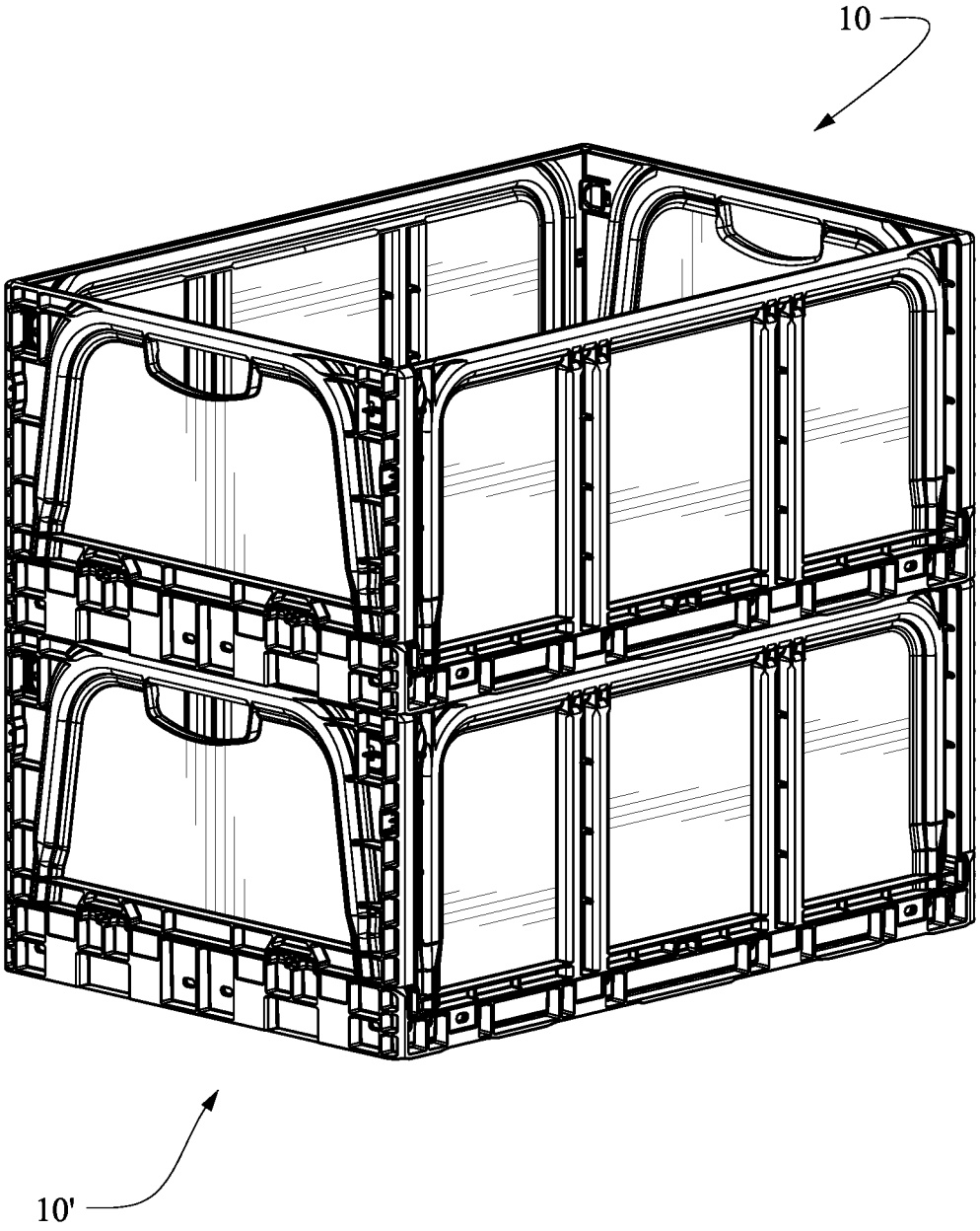

FIGS. 1 and 2 show a crate 10 according to described embodiments configured for blind-stacking on an adjacent crate 10'. The crate 10 includes a bottom panel 12, end walls 14 protruding from the bottom panel 12, and sidewalls 16 extending from the bottom panel and connected between the end walls 14. The sidewalls 16 include a stacking rim 18 on a top surface.

In order to facilitate blind-stacking, the bottom panel 12 is provided with one or more guide ribs 20 generally under or aligned with the sidewalls 16.

Figure 3:
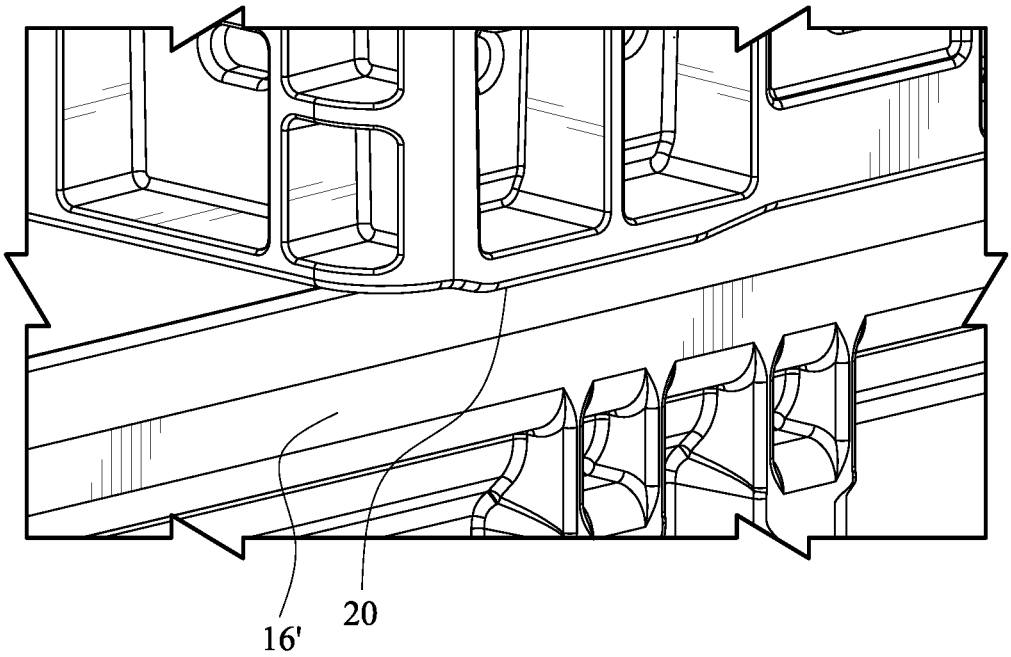
FIG. 3 is a close-up view of a guide rib that engages the sidewall of the adjacent crate.
Figure 4:
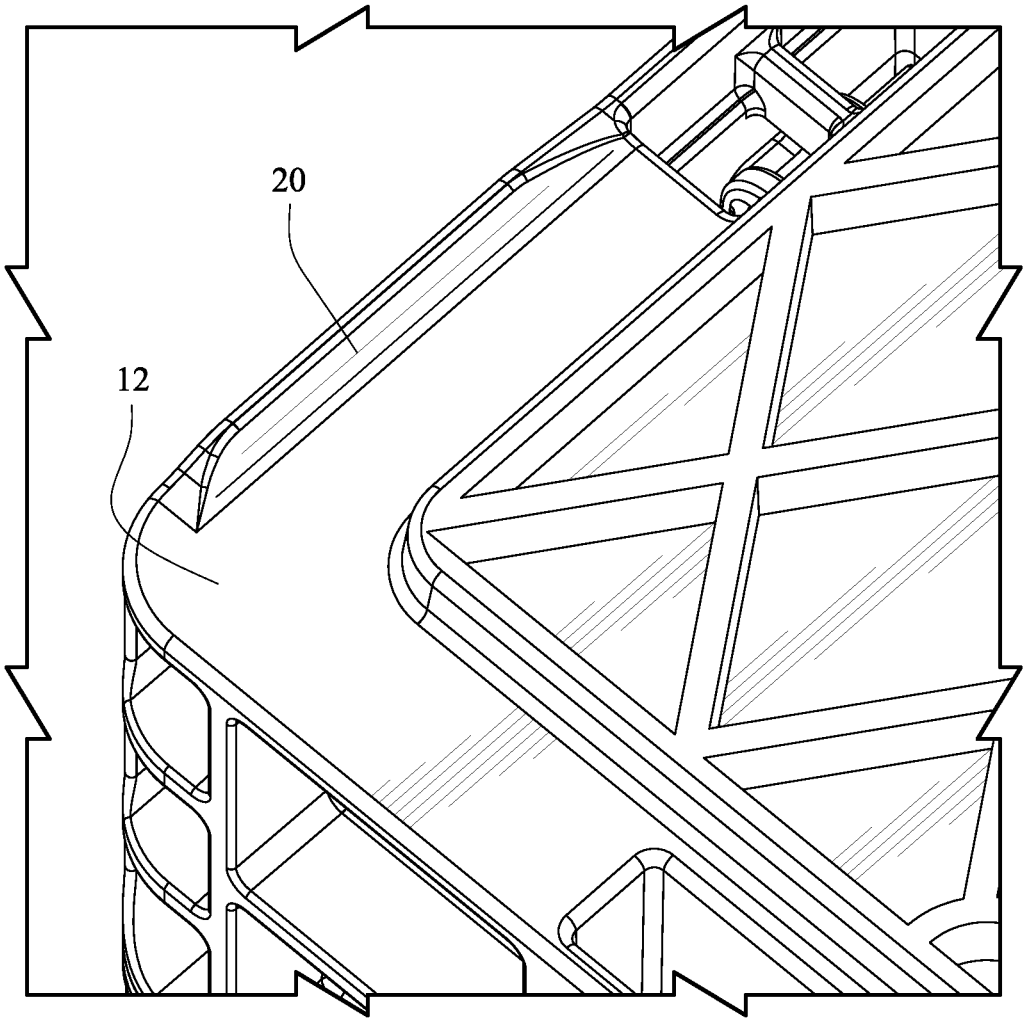
FIG. 4 is a bottom view of the guide rib.

With reference to FIGS. 3 and 4, in some embodiments, the guide ribs 20 are positioned adjacent forward ends of the crate 10 (relative to the direction of travel), where the guide ribs 20 are sized and shaped to positively engage the sidewalls 16' of the adjacent crate 10'. The guide rib 20 thus provides a positive locking of the bottom panel 12 to the top of the sidewalls 16' of the adjacent crate 10'. The positive lock with the sidewalls 16' can be maintained while sliding the crate 10 into the nested position. The guide ribs 20 are preferably as close as possible to the front of the crate 10 (relative to the travel direction) to maximize engagement with the adjacent crate 10'. The positive lock between the bottom panel 12 and the top of the sidewalls 16' of the adjacent crate 10' is an advantageous feature of the described embodiments.

With continued reference to FIG. 4, an exemplary geometry of the guide ribs 20 and bottom panel 12 complement a shape of the stacking rim 18. Thus, if the geometry of the stacking rim is modified, e.g., to a rectangular or chamfered recess, the geometry of the guide rib 20 could be adjusted accordingly.

In some embodiments, at least portions of the guide ribs 20 are spaced apart by a distance greater than a distance between the sidewalls 16. As such, as shown in FIG. 3, at least a portion of the guide ribs 20 is positioned outside of a width dimension of the sidewalls 16 such that the guide ribs 20 prevent the sidewalls from bending out under load. These loads could be upwards of 400-500 lbs. onto the crate at the bottom of a stack. This feature provides the ability to blind-stack securely.

Figure 3A:
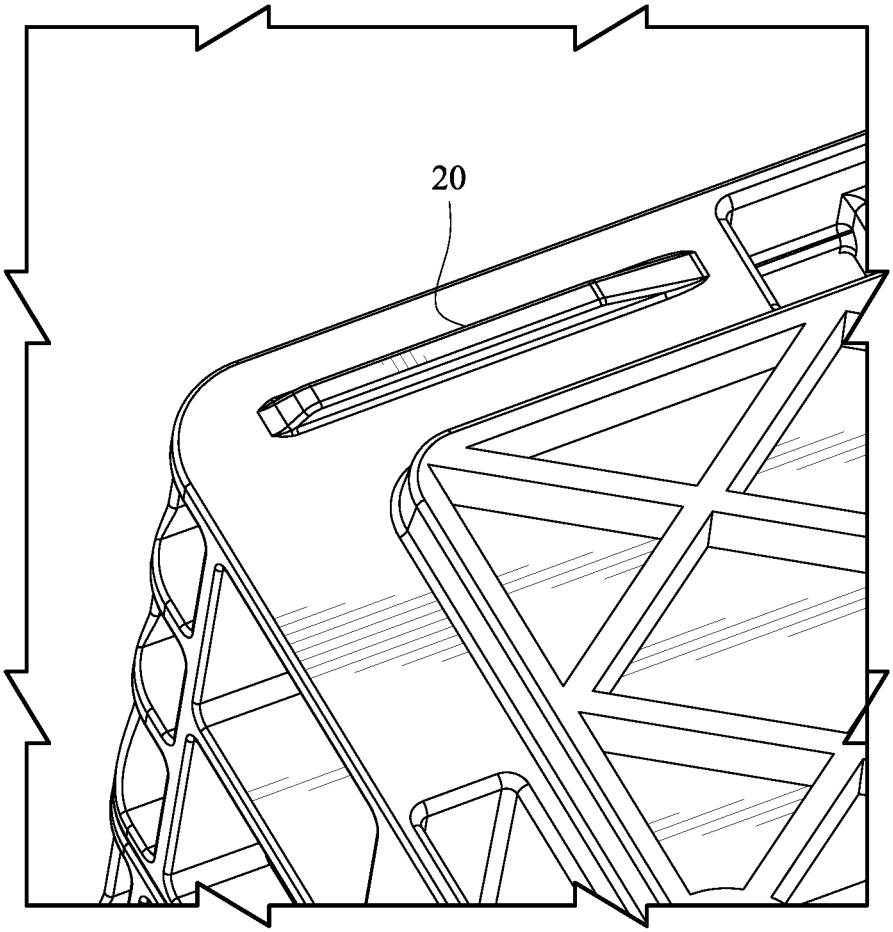
FIGS. 3A, 3B and 3C show an embodiment with a guide rib engaging a central groove in the adjacent crate.
Figure 3B:
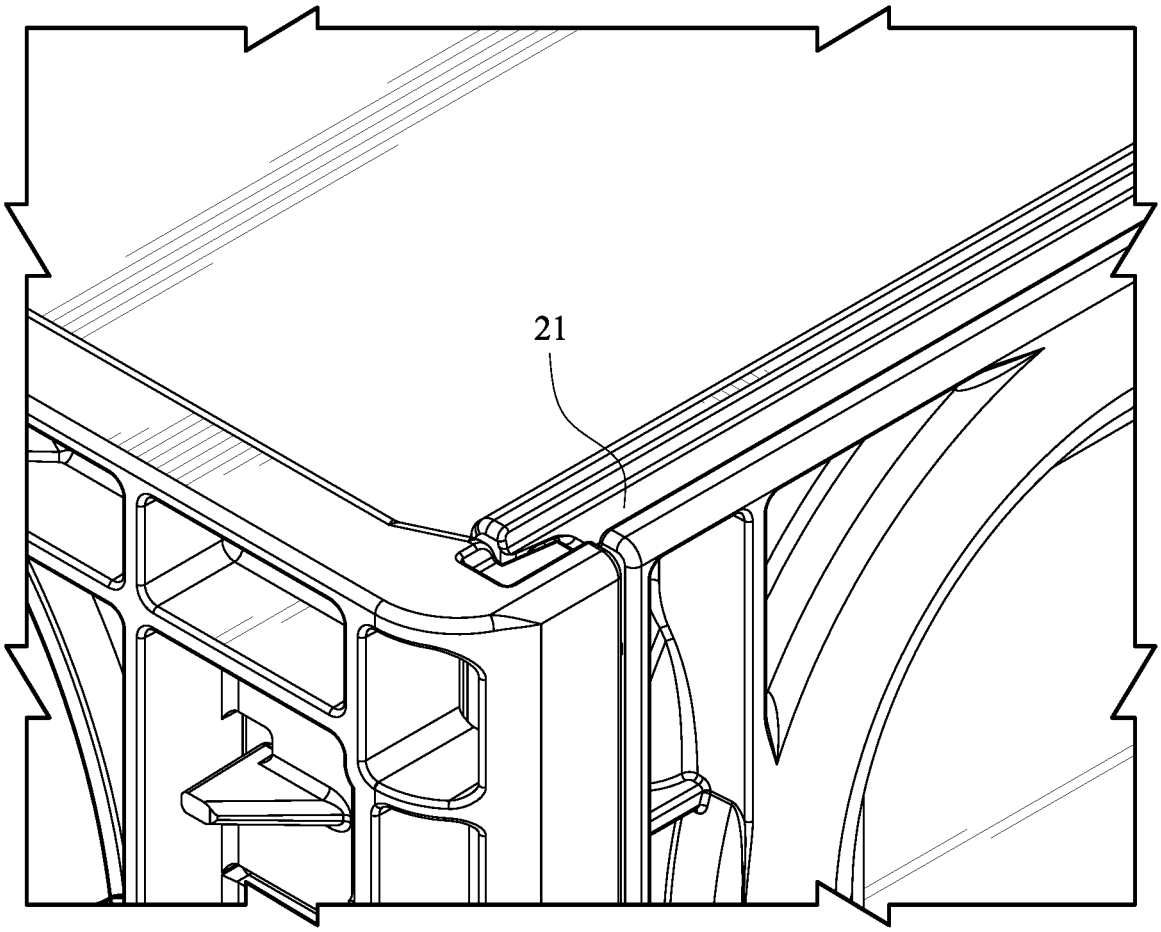
Figure 3C:
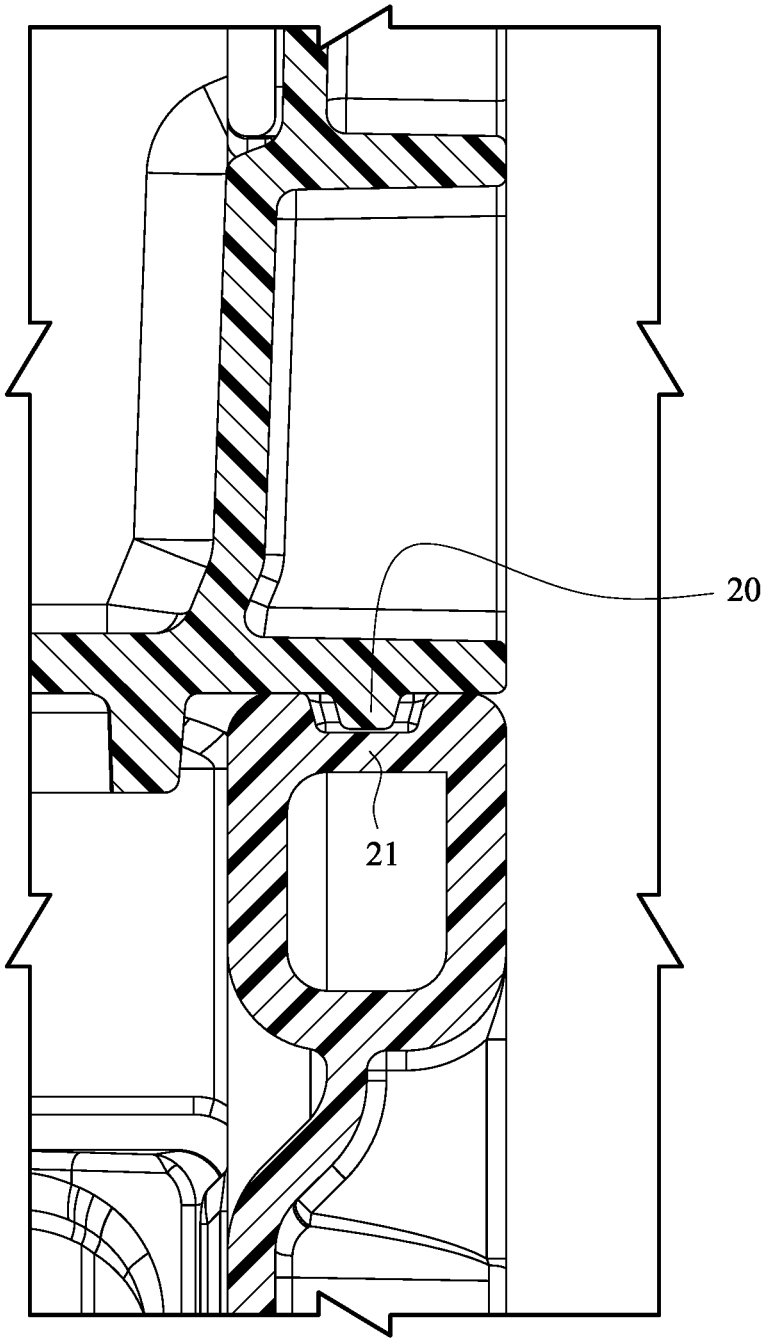

In some embodiments, with reference to FIGS. 3A, 3B and 3C, the stacking rim 18 may be provided with a central groove 21, where the guide ribs 20 are positioned in alignment with the central groove.

In some embodiments, the bottom panel 12 includes guide ribs 20 on both forward and aft ends of the crate 10 so that the crate can be blind-stacked in either orientation and to better prevent the walls of the adjacent crate 10' from bending out under load.

Figure 5:
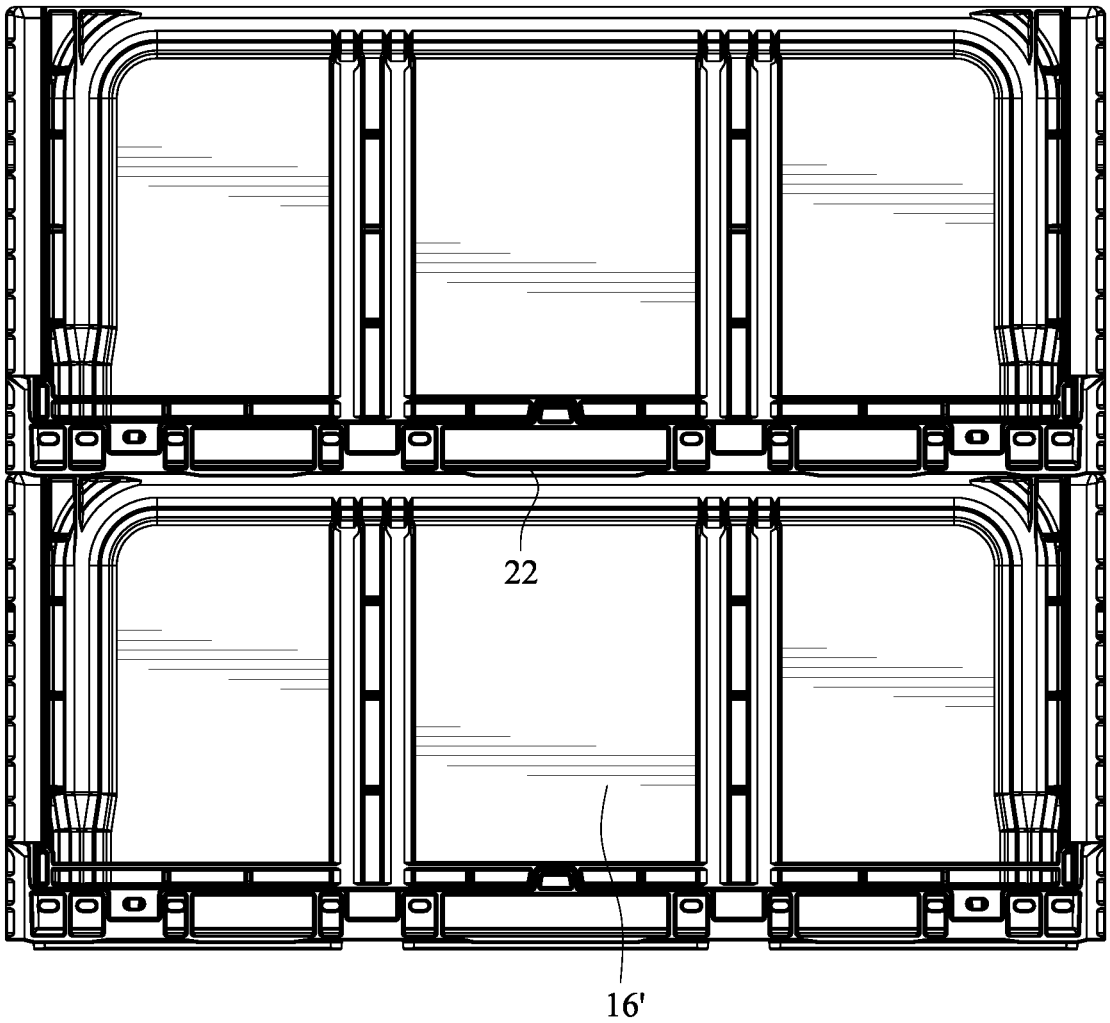
FIGS. 5-7 are various views of the interlocking rib.
Figure 6:
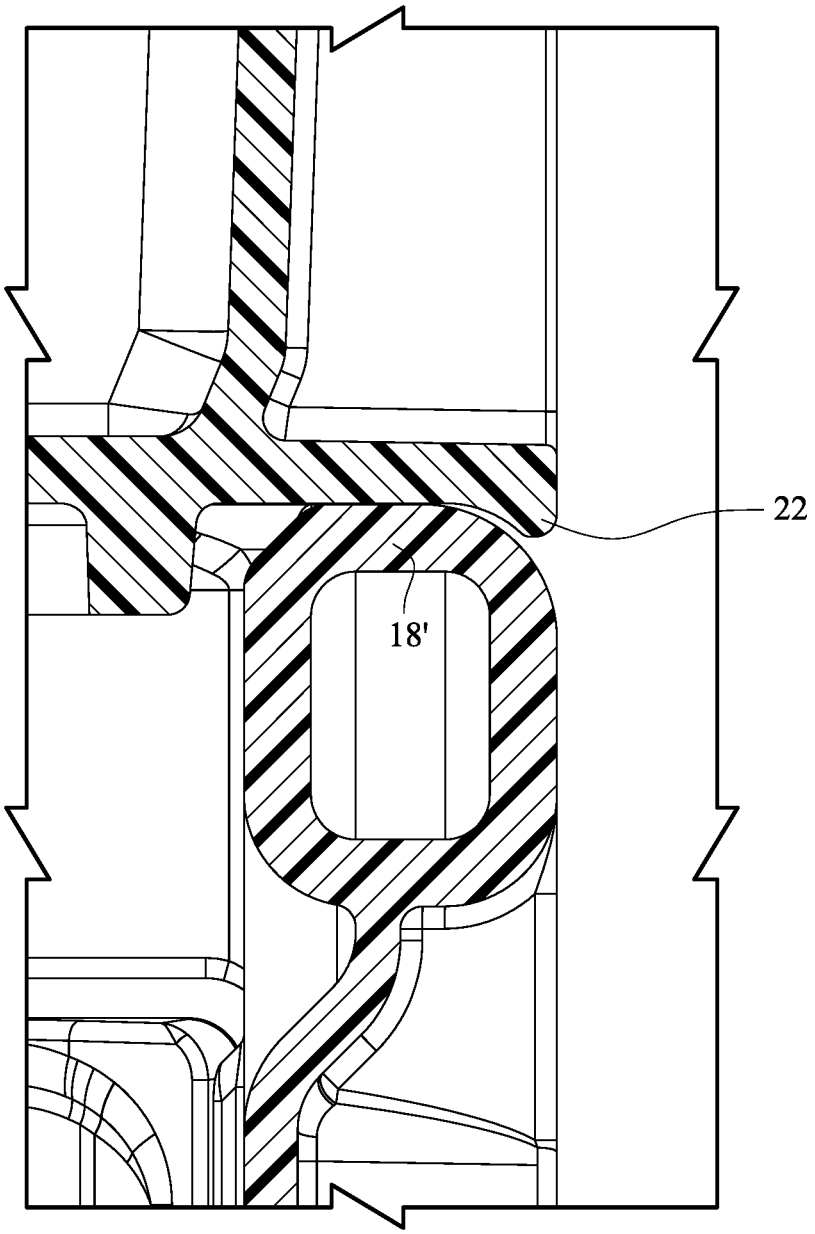
Figure 7:
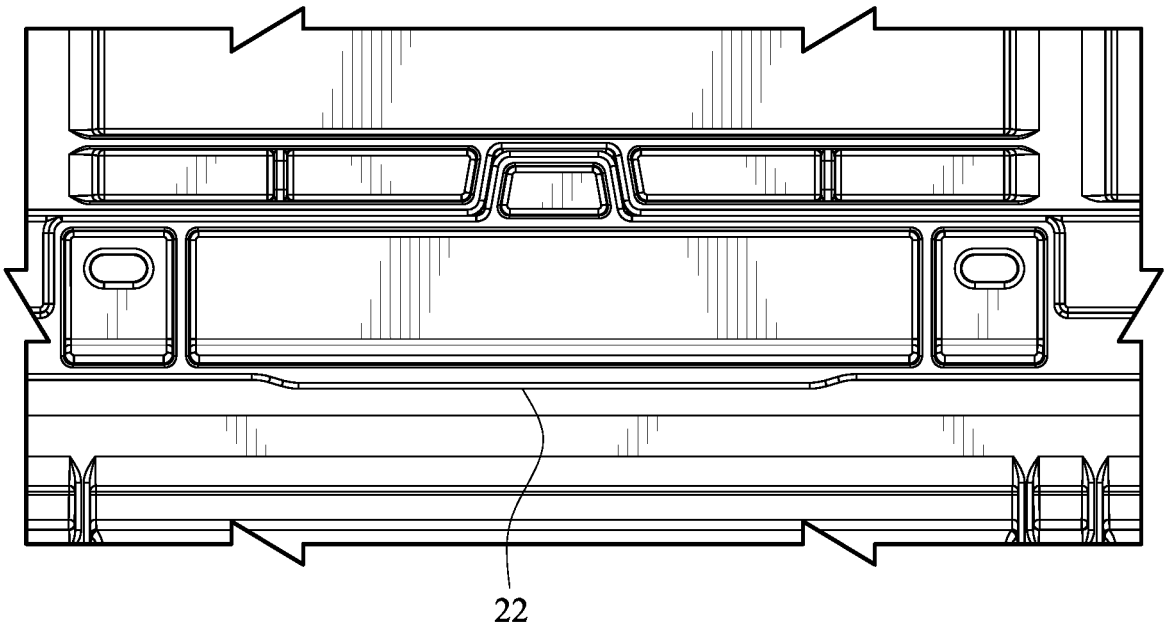

The bottom panel 12 may be further provided with interlocking ribs 22 under the sidewalls 16, respectively, and positioned between forward and aft ends of the crate 10. With reference to FIGS. 5-7, the interlocking ribs 22 are generally sized and shaped to positively engage the sidewalls 16' of the adjacent crate 10'. More specifically, the interlocking ribs 22 may be configured according to a shape of the stacking rim 18 (stacking rim 18' of the adjacent crate 10' shown in FIG. 6). A geometry of the interlocking ribs 22 and bottom panel 12 preferably complement a shape of the stacking rim 18. The function of the interlocking ribs 22 is generally the same as the guide ribs 20, but the interlocking ribs 22 are only active in the nested position. The interlocking ribs 22 similarly create a positive lock, which prevents the sidewalls 16' of the adjacent crate 10' from moving outwards under load.

Figure 8:
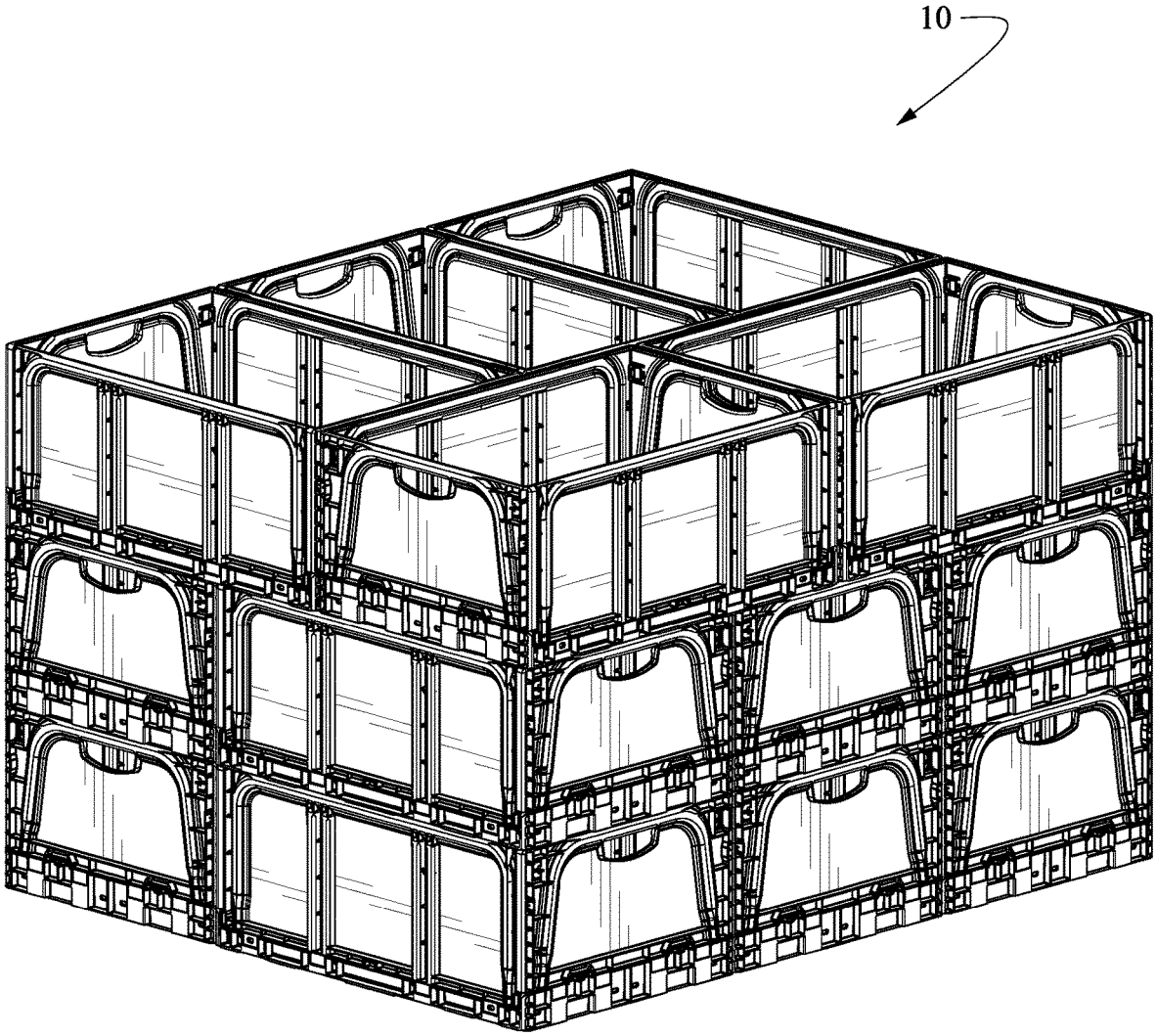
FIG. 8 shows an exemplary configuration with crates in a cross-stacked pattern.

Often, a mix of column and cross-stacking is used to build up crate stacks (see FIG. 8). For cross-stacking, blind-stacking as described above is not possible. In case of cross-stacking, the function of the guide ribs 20 changes such that the guide ribs 20 function as interlocking ribs. The interlocking ribs of the described embodiments greatly improve the stability (integrity) in column and cross-stacked patterns.

In a scenario where blind-stacking is not required (e.g., for automated palletizing), the interlocking ribs 22 could be added to all four sides of the bottom panel 12. That is, the bottom panel 12 may include interlocking ribs under the end walls 14, where the interlocking ribs are sized and positioned to positively engage end walls 14' of the adjacent crate 10'.

In blind-stacking the crate 10 on the adjacent crate 10', the guide ribs 20 are first aligned with the sidewalls 16' of the adjacent crate 10'. The guide ribs 20 are positively engaged with the sidewalls 16' of the adjacent crate 10. In this manner, as discussed above, the guide ribs 20 thereby prevent the sidewalls 16' of the adjacent crate 10' from deflecting outward under load. With the guide ribs 20 positively engaging the sidewalls 16' of the adjacent crate 10', the crate 10 is slid over the adjacent crate 10' to a stacked position (FIG. 2).

With the addition of interlocking ribs 22 under the sidewalls 16, respectively, and positioned between forward and aft ends of the crate 10, the blind-stacking process may also include positively engaging the interlocking ribs 22 with the sidewalls 16' of the adjacent crate 10'. In this embodiment, while sliding the crate 10 over the adjacent crate 10' to the stacked position, the interlocking ribs 22 may be positively engaged with the sidewalls 16' of the adjacent crate 10'. The positive engagement of the guide ribs 20 and the sidewalls 16' of the adjacent crate 10' may encompass the guide ribs 20 being positioned at least partially outside of the sidewalls 16' of the adjacent crate 10'.

If the sidewalls 16' of the adjacent crate 10' include a central groove, the positive engagement between the guide ribs 20 and the sidewalls 16' of the adjacent crate 10' may be achieved by inserting the guide ribs 20 into the central grooves.

The crate according to the described embodiments facilitates blind-stacking and helps to minimize the effort (more ergonomically/less lifting time) for an operator to handle heavier crates. Moreover, the design provides an outer guide rib at least at the front of the bottom of the base that prevents the walls from bending out under load. The addition of interlocking ribs provides additional support and integrity.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A crate configured for blind-stacking on an adjacent crate with side walls, the crate comprising:

a bottom panel;

end walls extending from the bottom panel, the end walls defining a forward end and an aft end of the crate; and side walls extending from the bottom panel and connected between the end walls, the side walls including a stacking rim on a top surface, wherein the bottom panel comprises a pair of guide ribs under each of the side walls, respectively, and positioned adjacent the forward and aft ends of the crate, the guide ribs being sized and shaped to positively engage the side walls of the adjacent crate, and the guide ribs being configured to prevent the side walls of the adjacent crate from deflecting outward under load, wherein the guide ribs are configured such that the crate is blind-stackable along an entire length of the side walls with the forward end leading and with the aft end leading, and wherein the bottom panel further comprises interlocking ribs under the end walls, respectively, the interlocking ribs being sized and positioned to positively engage end walls of the adjacent crate.

2. A crate according to claim 1, wherein at least portions of the guide ribs are spaced apart by a distance greater than a distance between the side walls.

3. A crate according to claim 1, wherein a geometry of the guide ribs and bottom panel complement a shape of the stacking rim.

4. A crate according to claim 1, wherein the bottom panel further comprises interlocking ribs under the side walls, respectively, and positioned between the forward and aft ends of the crate and between the pair of guide ribs, the interlocking ribs being sized and shaped to positively engage the side walls of the adjacent crate.

5. A crate according to claim 4, wherein a geometry of the interlocking ribs and bottom panel complement a shape of the stacking rim.

6. A crate configured for blind-stacking on an adjacent crate with side walls, the crate comprising:

a bottom panel;

end walls extending from the bottom panel, the end walls defining a forward end and an aft end of the crate; and side walls extending from the bottom panel and connected between the end walls, the side walls including a stacking rim on a top surface, wherein the bottom panel comprises a pair of guide ribs under each of the side walls, respectively, and positioned adjacent the forward and aft ends of the crate, the guide ribs being sized and shaped to positively engage the side walls of the adjacent crate, and the guide ribs being configured to prevent the side walls of the adjacent crate from deflecting outward under load, wherein the guide ribs are configured such that the crate is blind-stackable along an entire length of the side walls with the forward end leading and with the aft end leading, wherein the stacking rim includes a central groove, and wherein the guide ribs are positioned in alignment with the central groove.

7. A method of blind-stacking a crate on an adjacent crate with side walls, the crate including a bottom panel, end walls extending from the bottom panel and defining a forward end of the crate and an aft end of the crate, and side walls extending from the bottom panel and connected between the end walls and including a stacking rim on a top surface, wherein the bottom panel is provided with guide ribs under the side walls, respectively, and positioned adjacent the forward and aft ends of the crate, the method comprising:

(a) with either the forward end or the aft end leading, aligning the guide ribs with the side walls of the adjacent crate;

(b) positively engaging the guide ribs and the side walls of the adjacent crate, wherein the guide ribs are configured to prevent the side walls of the adjacent crate from deflecting outward under load; and (c) with the guide ribs positively engaging the side walls of the adjacent crate, sliding the crate over the adjacent crate to a stacked and nested position, the sliding step being practiced such that the crate is blind-stackable to the nested position along an entire length of the side walls with the forward end leading and with the aft end leading.

8. A method according to claim 7, wherein the crate further includes interlocking ribs under the side walls, respectively, and positioned between the forward and aft ends of the crate, the method further comprising positively engaging the interlocking ribs with the side walls of the adjacent crate, and wherein step (c) is practiced at least partially with the interlocking ribs positively engaging the side walls of the adjacent crate.

9. A method according to claim 7, wherein step (b) is practiced by positioning the guide ribs at least partially outside of the side walls of the adjacent crate.

10. A method according to claim 7, wherein each of the side walls of the adjacent crate includes a central groove, and wherein step (b) is practiced by inserting the guide ribs into the central grooves.

11. A crate configured for blind-stacking on an adjacent crate with side walls, a central groove and an exterior shape, the crate comprising:

a bottom panel;

end walls extending from the bottom panel; and side walls extending from the bottom panel and connected between the end walls, the side walls including a stacking rim on a top surface, wherein the bottom panel comprises guide ribs under the side walls, respectively, and positioned adjacent a forward end of the crate, at least portions of the guide ribs being spaced apart by a distance greater than a distance between the side walls, and wherein a geometry of the guide ribs and bottom panel complement a shape of the stacking rim such that the guide ribs are configured to prevent the side walls of the adjacent crate from deflecting outward under load by engaging the central groove of the adjacent crate, and wherein the bottom panel further comprises interlocking ribs under the side walls, respectively, and positioned between forward and aft ends of the crate, the interlocking ribs being sized and shaped to positively engage the exterior shape of the adjacent crate side walls along an entire length of the adjacent crate side walls.

12. A crate according to claim 11, wherein a geometry of the interlocking ribs and bottom panel complement the exterior shape.

13. A crate according to claim 11, wherein the bottom panel further comprises interlocking ribs under the end walls, respectively, the interlocking ribs being sized and positioned to positively engage end walls of the adjacent crate.

* * * * *